US012667158B2

(12) United States Patent
Fusco et al.

(10) Patent No.: US 12,667,158 B2
(45) Date of Patent: Jun. 30, 2026

(54) FOOTWEAR SOLE WITH COMPLEX CURVE

(71) Applicant: KEEN, Inc., Portland, OR (US)

(72) Inventors: Ciro Fusco, Portland, OR (US); Rory Fuerst, Jr., Tahoe City, CA (US)

(73) Assignee: KEEN, INC., Portland, OR (US)

( * ) Notice: Subject to any disclaimer, the term of this patent is extended or adjusted under 35 U.S.C. 154(b) by 81 days.

(21) Appl. No.: 18/499,159

(22) Filed: Oct. 31, 2023

(65) Prior Publication Data

US 2024/0138514 A1 May 2, 2024

Related U.S. Application Data

(60) Provisional application No. 63/381,734, filed on Oct. 31, 2022.

(51) Int. Cl.
*A43B 5/06* (2022.01)
*A43B 13/14* (2006.01)

(52) U.S. Cl.
CPC ..... *A43B 5/06* (2013.01); *A43B 13/14* (2013.01); *A43B 13/145* (2013.01)

(58) Field of Classification Search
None
See application file for complete search history.

(56) References Cited

U.S. PATENT DOCUMENTS

| | | | | |
|---|---|---|---|---|
| 3,835,556 | A * | 9/1974 | Panaretos | A43B 13/145 36/28 |
| 4,372,059 | A * | 2/1983 | Ambrose | A43B 13/184 36/103 |
| 5,052,130 | A | 10/1991 | Barry et al. | |
| 6,944,972 | B2 | 9/2005 | Schmid | |
| 7,266,912 | B2 | 9/2007 | Whatley | |
| 9,289,028 | B1 * | 3/2016 | Anderson | A43B 7/148 |
| 11,134,748 | B2 * | 10/2021 | Geis | A43B 13/18 |
| 2012/0317835 | A1 | 12/2012 | Raysse et al. | |
| 2014/0047740 | A1 | 2/2014 | Tucker et al. | |
| 2018/0255868 | A1 * | 9/2018 | Cole | A43B 13/42 |
| 2020/0245717 | A1 * | 8/2020 | Fusco | A43B 13/026 |
| 2021/0055786 | A1 * | 2/2021 | Galifi | A43B 3/44 |
| 2022/0031016 | A1 * | 2/2022 | Geis | A43B 13/145 |

FOREIGN PATENT DOCUMENTS

| | | | |
|---|---|---|---|
| CN | 111955842 | A | 11/2020 |
| WO | 2020252236 | A1 | 12/2020 |

* cited by examiner

*Primary Examiner* — Jila M Mohandesi
(74) *Attorney, Agent, or Firm* — McCoy Russell LLP

(57) ABSTRACT

A sole for a footwear article is provided. In one example, the sole may have a bottom profile with a complex curve, the complex curve formed of a first curve at a heel region of the sole to provide a target landing angle of the sole, and a second curve at a ball region of the sole to provide a target exit angle of the sole. Each of the first curve and the second curve are a constant curve.

20 Claims, 8 Drawing Sheets

FOOTWEAR SOLE WITH COMPLEX CURVE

CROSS REFERENCE TO RELATED APPLICATIONS

The present application claims priority to U.S. Provisional Application No. 63/381,734 entitled "FOOTWEAR SOLE WITH COMPLEX CURVE", filed on Oct. 31, 2022. The entire contents of the above-listed application is hereby incorporated by reference for all purposes.

BACKGROUND/SUMMARY

A footwear article may support activities of a wearer based on its shape and materials incorporated into the footwear article. For example, the footwear article may be adapted for a specific use, such as for running, and may have a configuration that absorbs impact when the wearer's foot strikes a ground surface and allows the wearer to perform an activity efficiently, e.g., with less fatigue and optimal positioning of lower extremity joints. As such, a profile of the sole may affect energy conservation, stability, and user comfort depending on an intended use of the footwear article. By optimizing a geometry and material properties of the sole according to end use, the footwear article may promote positioning of the foot in an ideal position for both landing on and launching from the ground.

In one embodiment, a footwear article may include a sole having a bottom profile with a complex curve, the complex curve formed of a first curve at a heel region of the sole to provide a target landing angle of the sole, and a second curve at a ball region of the sole to provide a target exit angle of the sole, wherein the first curve and the second curve are each a constant curve. In this way, forces exerted on the wearer's foot upon contact with the ground may be dampened while energy output by the wearer may be transferred efficiently through the sole via the plate. The foot may be compelled to flex through a range of angles that reduces discomfort, maintains stable foot placement, and minimizes energy loss. As a result, activities, such as running and/or walking, may be performed for a longer duration of time and/or at a faster pace.

BRIEF DESCRIPTION OF THE FIGURES

The present disclosure will be better understood from reading the following description of non-limiting embodiments, with reference to the attached drawings, wherein below.

DETAILED DESCRIPTION

Figure 1:
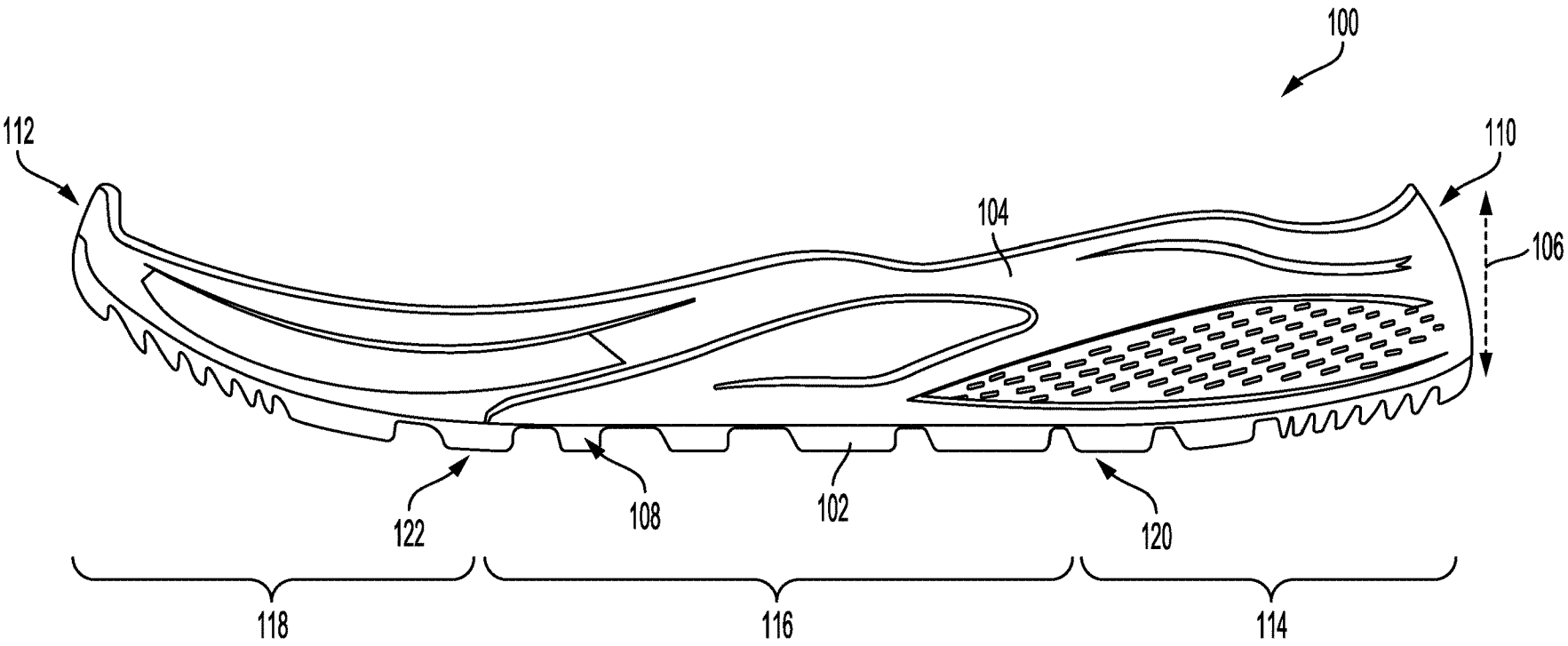
FIG. 1 shows an example of a sole for a footwear article.
Figure 2:
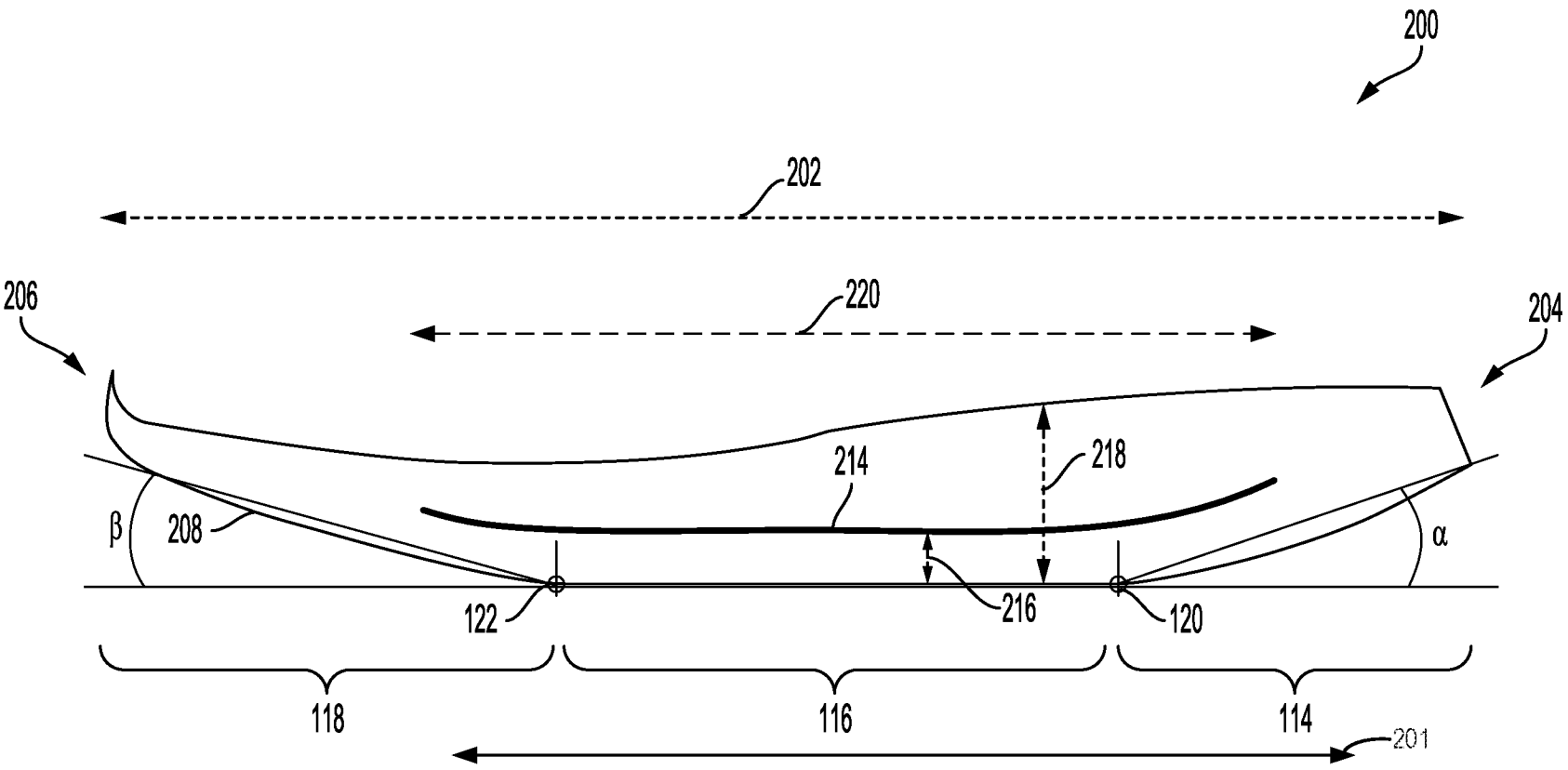
FIG. 2 shows a diagram of a sole having a profile with a complex curve and a moderation plate embedded in the sole.
Figure 3:
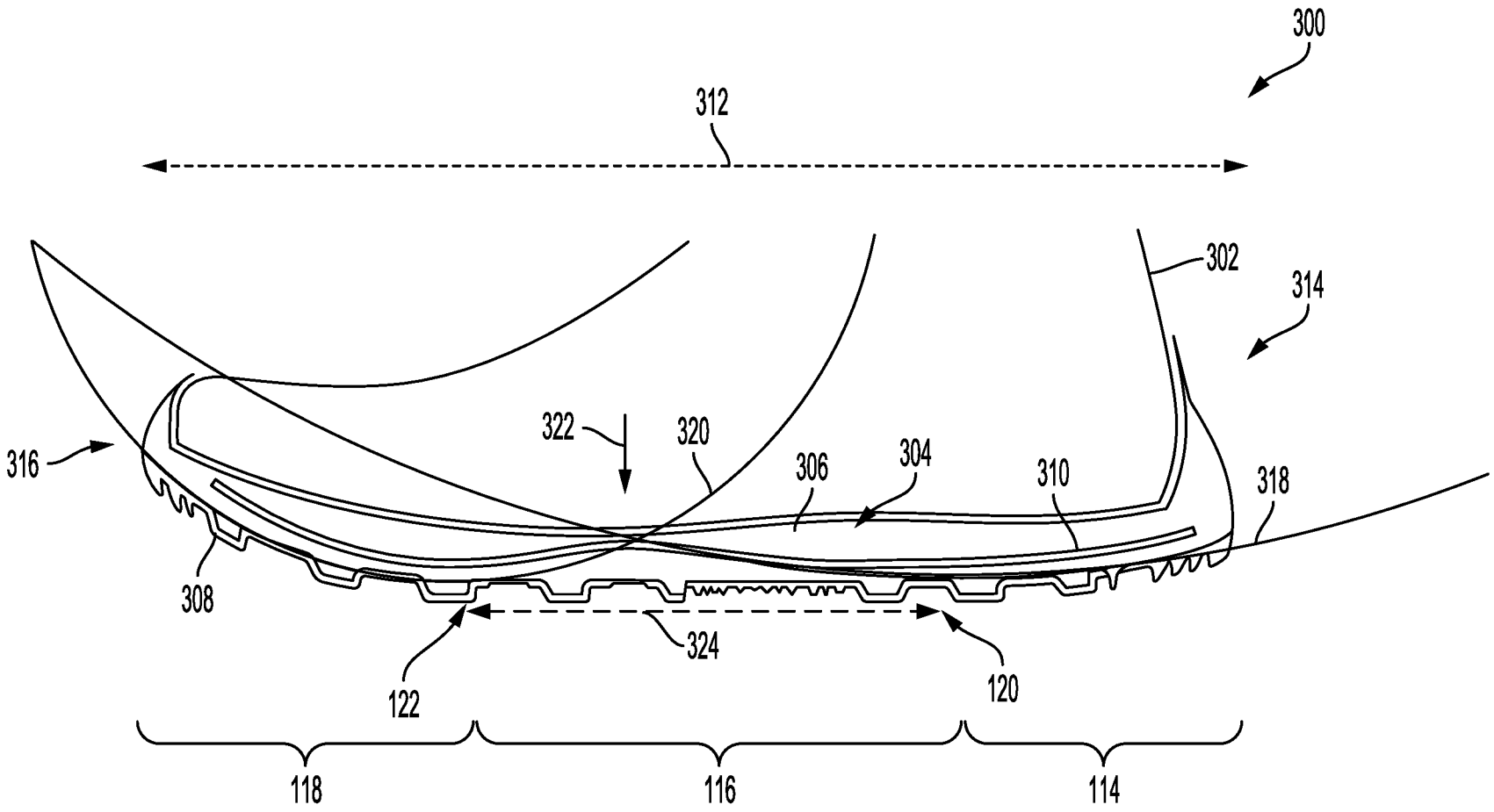
FIG. 3 shows an example of generation of a complex curve for a sole, the sole including a moderation plate, by overlaying the sole with curves of specific radii.
Figure 4:
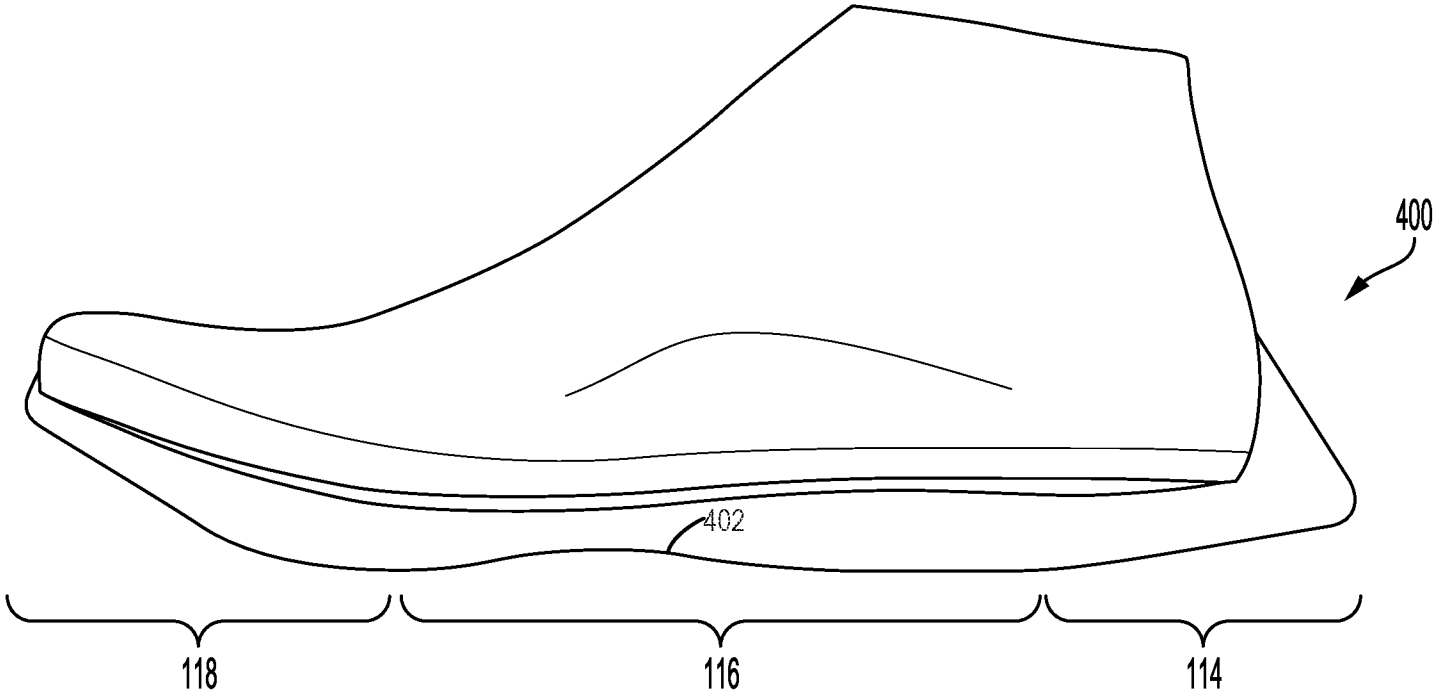
FIG. 4 shows a first example of a complex curve profile for a sole.
Figure 5:
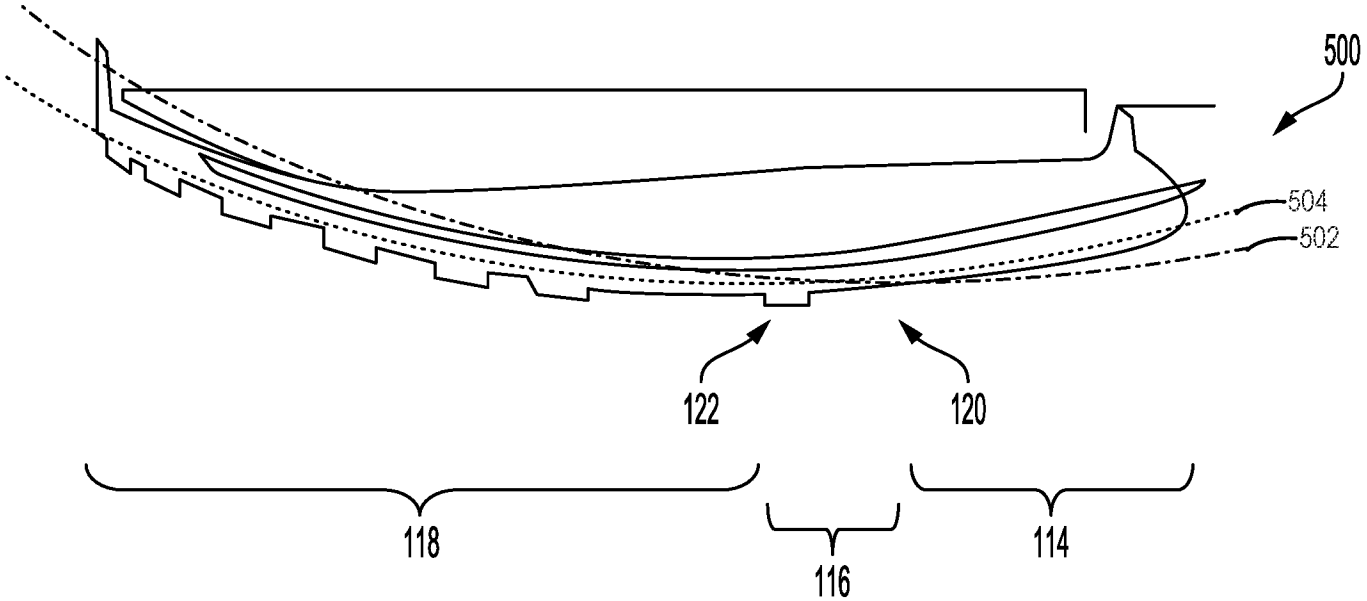
FIG. 5 shows a second example of a complex curve profile for a sole.
Figure 6:
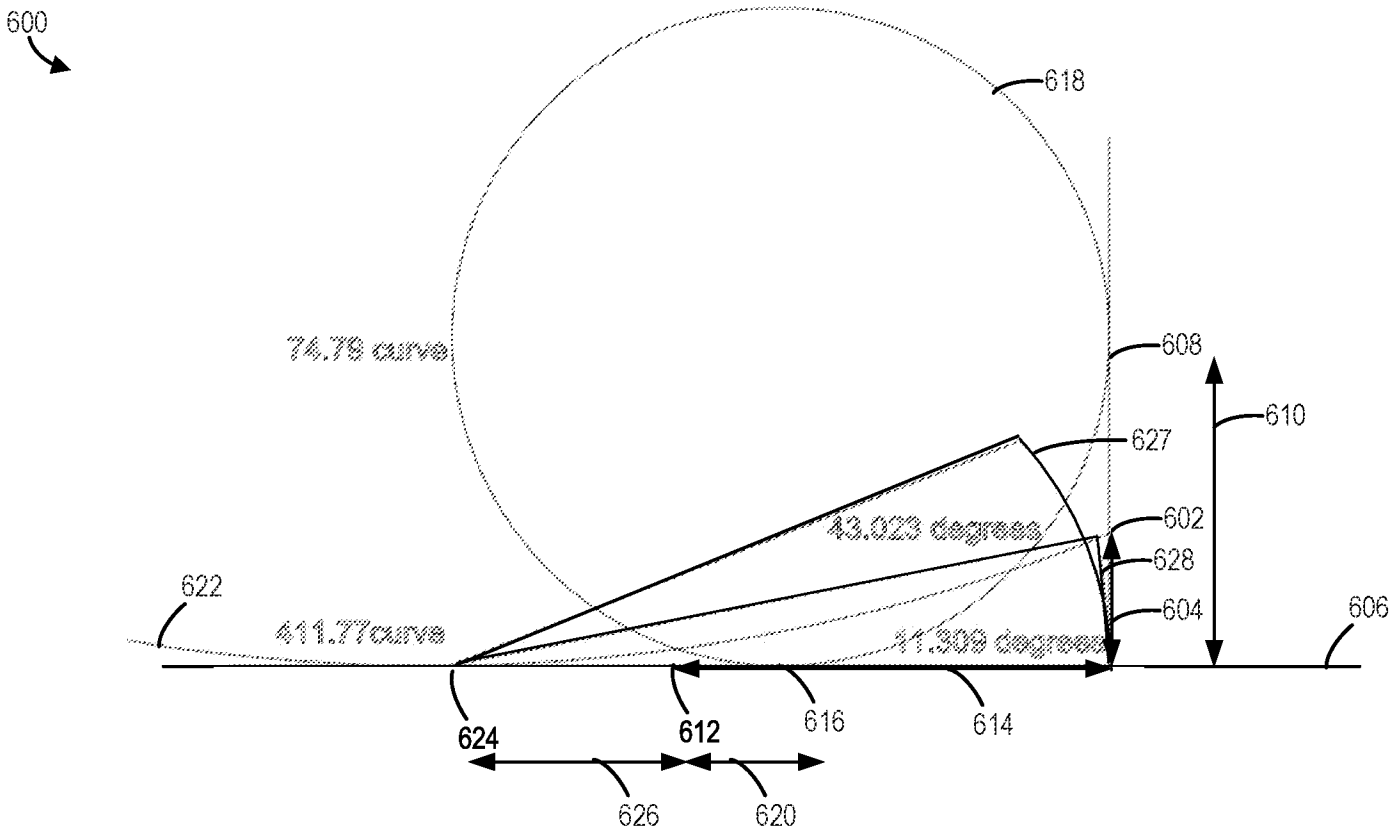
FIG. 6 shows a diagram of a toe region including a range of ball points and toe tip heights.
Figure 7:
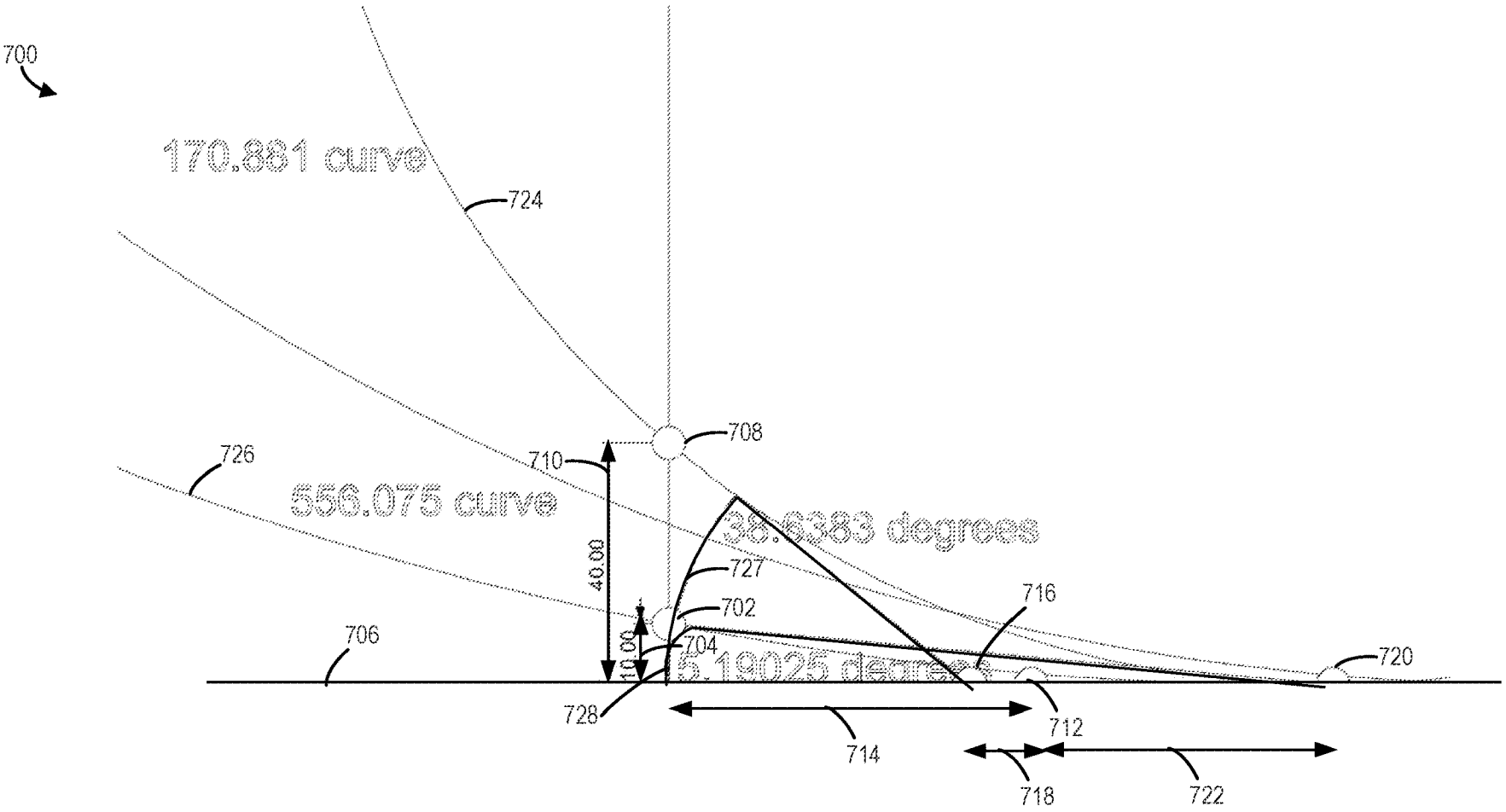
FIG. 7 shows a diagram of heel region including a range of heel low points and heel tip heights.
Figure 8:
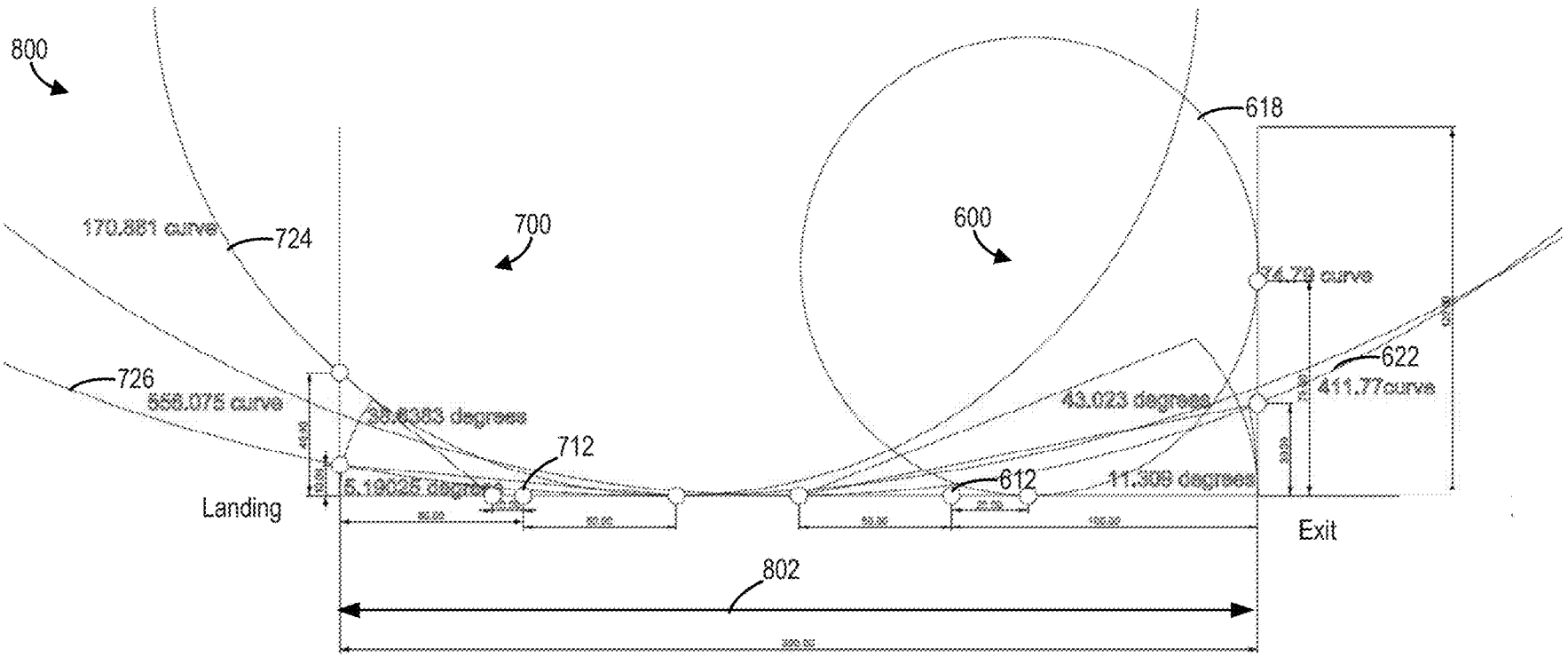
FIG. 8 shows a diagram of a sole including the toe region of FIG. 6 and the heel region of FIG. 7.

The following description relates to a sole for a footwear article. The footwear article may be a shoe adapted for a specific type of activity based on a configuration of the sole. An example of a sole is depicted in FIG. 1, and a diagram indicating angles of the sole that affect foot movement is shown in FIG. 2. In one example, as described herein, the sole may be a profile having a complex curve configured to enhance stability, energy transfer, and absorption of impact of the sole. As illustrated in FIG. 3, the complex curve may be generated by incorporating more than one curve into the profile, each curve having target radius. In one example, the complex curve may include at least two curves. Additional examples of the complex curve are shown in FIGS. 4 and 5. Ranges of the complex curves are shown in FIGS. 6, 7, and 8.

Turning now to FIG. 1, a sole 100 for a footwear article is shown from a side view, according to an embodiment. It will be appreciated that the sole 100 is a non-limiting example and variations in its configuration are possible without departing from the scope of the present disclosure. The sole 100 may include an outsole 102, a midsole 104, and an insole (not shown). The outsole 102 may include an exposed surface of the sole 100 that is contact with and configured to interface with a ground surface, e.g., an exterior, ground-interfacing side of the sole 100. In some examples, the exposed surface of the outsole 102 may include a texturized pattern and/or lugs to increase grip, durability, and water resistance. The outsole 102 may form a bottom, outermost layer of the sole 100 and the insole may form an innermost layer of the sole 100, e.g., positioned closest to the user's foot. In one example, the insole may be formed within the shoe (e.g., inside of) such that the insole is enclosed within an upper of the footwear article.

The midsole 104 may be a layer located between the insole and the outsole 102 and may be configured to absorb shock and provide cushioning. The midsole 104 may be coupled to an upper surface of the outsole 102 and a bottom surface of the insole. In some examples, particularly for athletic footwear articles, the midsole 104 may control pronation of the wearer's foot, thereby directly affecting the user's comfort while the footwear article is worn. A composition of the midsole 104 may determine a durability, absorptive and cushioning properties, and a useful life of the sole 100. For example, the midsole 104 may be formed of ethylene vinyl acetate (EVA), thermal polyurethane (TPU), polyurethane (PU), and/or combinations thereof.

An overall shape of the sole 100 may be determined by a geometry of the midsole 104. More specifically a bottom profile of the sole 100 may correspond to a bottom contour of the midsole 104. As shown in FIG. 1, a thickness 106 of the midsole 104 may be greater over an entire length of the sole 100 than a thickness 108 of the outsole 102. The outsole 102 may therefore be a relatively thin layer coupled to a bottom surface of the midsole 104 and may adhere to a contour of the bottom surface of the midsole 104. The midsole 104 may further include various texturing, indentations, protrusions, visual details along its side surfaces for aesthetic and/or utility purposes.

The sole 100 may therefore affect a propagation of movement through a wearer's lower extremities as well as transfer of energy from the wearer to a ground surface (hereafter, the ground) to propel the wearer in a desired direction. Such effects may be controlled based on both a shape of the sole 100 and mechanical properties of the sole 100, such as stiffness, compressibility, etc. As one example, regions of the sole 100 which directly contact the ground while the wearer is performing an activity such as running or walking may moderate dorsiflexion of the foot, where dorsiflexion is flexing of the foot such that the wearer's toes move closer to the wearer's shin. As the wearer's foot shifts through a stride, weight may be transferred through the foot and therefore the sole 100, from a heel end 110 to a toe end 112 of the sole 100. Contact between the sole 100 and the ground may proceed through a set of regions of the sole 100, the set of regions including a first region 114, a second region 116, and a third region 118.

The first region 114 may be proximate to the heel end 110 of the sole 100, extending between the heel end 110 and a first point of contact 120 between the sole 100 and the ground, and may represent a portion of the sole 100 supporting a heel of the wearer's foot. The second region 116 may be a central, or transition region of the sole 100, arranged under an arch of the wearer's foot and extending between the first point of contact 120 and a second point of contact 122 of the sole with the ground. The third region 118 may be proximate to the toe end 112 of the sole 100 and positioned below a ball and metatarsals of the wearer's foot. Hereafter, the first, second and third regions may also be referred to as a heel region, a central region, and a ball region, respectively.

When the sole 100 is in a neutral position, e.g., stationary on a ground surface without any force exerted on the sole, the first region 114 of the sole 100 does not contact the ground except at the first point of contact 120 and the third region 118 does not contact the ground except at the second point of contact 122. When the footwear article is worn by a wearer and the wearer performs an activity, such as running or walking having a conventional stride in a forward direction, the sole 100 may be lifted off the ground initially during a stride and may contact the ground at the first region 114 before the second or third regions 116, 118. As the stride progresses, contact between the sole 100 and the ground may shift through the second region 116 and then through the third region 118 before the sole 100 is lifted again above the ground. Impact imposed on the foot during the stride may be greatest upon initial contact at the first region 114. Forward propulsion of the wearer may be greatest when the third region 118 is in contact with the ground. Efficient transfer of energy, e.g., with minimal losses, from the first region 114 to the third region 118 may therefore be desirable. Further details of the set of regions and the points of contact are provided below, with reference to FIG. 2.

A simplified diagram of a sole 200 is shown in FIG. 2, with the set of regions of FIG. 1 similarly indicated in FIG. 2. The sole 200 may include a midsole and an outsole. Each region of the set of regions may form a different portion of a length 202 of the sole 200. In other words, each region may have a different length from the other regions. In one example, the length of each of the first, second, and third regions 114, 116, 118, may be adjusted according to target angles at each of a heel end 204 and a toe end 206 of the sole 200. For example, one of the target angles may be a landing angle α, which may be an angle formed between the ground and bottom surface 208 of the sole 200 at the first region 114. In some examples, the landing angle α may determine dorsiflexion of the foot when the sole 100 initially contacts the ground during a walking or running stride. An apex of the landing angle α may be the first point of contact 120 between the sole 200 and the ground.

The first point of contact 120 may be selectively positioned along the sole 200 to promote optimal foot flexion, where its positioning may be varied depending on activity. In one example, the first point of contact 120 may be positioned at a point corresponding to a lowest point of a heel of a last used to form the sole 200, with respect to a direction of gravity (e.g., the direction towards the ground when the shoe is being used) and a curvature of the heel of the last. The first point of contact 120 may be shifted within a range between up to and including 10 mm towards the heel end 204 of the sole 200, away from the lowest point of the heel of the last, and up to and including 50 mm towards the toe end 206 of the sole 200, away from the lowest point of the heel of the last. In some examples, the first point of contact may be shifted up to and including 75 mm towards the toe end 206 of the sole 200. As an example, the first point of contact 120 may be shifted towards the heel end 204 as an anticipated intensity of use of the sole 200 increases. For example, the first point of contact 120 may be closer towards heel end 204 in a shoe for running when compared to the first point of contact 120 in a shoe for walking.

The second point of contact 122 may be aligned based on geometric considerations which may correspond to a ball of the foot of the wearer in one example, but may not be aligned with the ball of the foot in other examples. For example, the second point of contact 122 may be located at a distance that is ¼ of a length of the last used to form the sole 200, when the last is at 0° of dorsiflexion. The second point of contact 122 may shift forwards or rearwards of a point equal to ¼ of the last length depending on a curvature of the third region 118 of the sole 200. As one example, a target exit angle β (described further below) of the sole may be 32° and the second point of contact 122 may be positioned to achieve the target exit angle according to the curvature of the third region 118. The second point of contact 122 may be shifted up to and including 50 mm towards the heel end 204 and up to and including 25 mm towards the toe end 206 of the sole 200, relative to the point corresponding to ¼ of the length of the last. In further examples, the second point of contact 122 may be shifted up to and including 75 mm towards the heel end 204.

In an alternate embodiment, the second point 122 of contact may be located at a distance that a third of a length of the last used to form the sole 200, when the last is at 0° of dorsiflexion and the second point of contact 122 may be shifted relative to the point equal to a third of the last length depending on a curvature of the third region 118 of the sole 200.

As the stride progresses, the wearer's weight is shifted from the heel end 204 of the sole 200 to the toe end 206. Contact between the sole 200 and the ground may be transferred from the first region 114 to the third region 118 via the second region 116. The sole 200 may be shaped to have another of the target angles at the toe end 206, which may be the exit angle β, formed between the ground and the bottom surface of the sole 200 at the third region 118. The exit angle β may control an angle of the foot, e.g., plantar flexion where the foot flexes in an opposite direction of dorsiflexion, when the sole 200 loses contact with the ground at an end of the stride. The exit angle β may also determine a location along the sole 200 of the second point of contact 122 between the sole 200 and the ground, which may also be an apex of the exit angle β. In one example, the target angles may be adapted for running and may correspond to 17° at the landing angle α and 32° at the exit angle β.

In order to achieve the target angles at the heel end 204 and the toe end 206 of the sole 200, a profile of the sole 200 may be configured with a complex curve, where the complex curve is generated by incorporating more than one curve into the profile, each curve having a distinct radius (e.g., each having a different radii) of curvature, as shown in FIG. 3 and described further below. The curves used to form the complex curve may determine a curvature of the sole at the first and third regions 114, 118, e.g., how the sole 200 extends away from the ground at either end of the sole, which accords the sole 200 a rocker profile. The radii of curvature may be selected to obtain arcs along the sole profile at the heel region 114 and the ball region 118 that provide the target landing and exit angles, respectively. The arcs along the profile at the heel region 114 and the ball region 118 may each be a constant curve. The central region 116 may be a transition region for transferring energy between the heel region 114 and the ball region 118, and may be configured, with respect to shape and mechanical properties, to accommodate a desired rate of energy transfer.

The central region 116 may be a neutral region, with respect to flexion of the foot. In one example, a bottom contour of the central region 116 may be flat with a linear profile parallel with a plane of the ground, as shown in FIGS. 1-3. In other examples, the central region 116 may be curved, as shown in FIGS. 4 and 5. Further, in one example, as depicted in FIG. 4, at least a portion of the sole 200 does not contact the ground when the sole 200 is in a neutral position and not compressed. A length of the central region 116 may vary depending on the radius of curvature of each of the curves and corresponding points of contact of each curve (e.g., the first and second points of contact 120, 122).

In one example, the sole 200 may include a plate 214 that extends through the central region 116 following a lengthwise direction indicated by arrow 201. The plate 214 may be a moderation plate that may assist in efficient energy transfer through the central region 116 of the sole 200. The plate 214 may also stabilize the sole 200 along the length 202 and a width of the sole 200 (the width defined as perpendicular to the length 202 along a common plane parallel with the ground). The plate 214 may also extend into a portion of the heel region 114 and a portion of the ball region 118 of the sole 200. A length 220 of the plate 214 may be shorter than the length 202 of the sole 200. For example, the length 220 of the plate 214 may be 30%, 50%, or 60% of the length 202 of the sole 200. As another example, the length of the plate 214 may be 30% to 80% of the length 202 of the sole 200 and the length may be selected based on mechanical properties of the plate 214. Similarly, a width of the plate 214 may be less than the width of the sole 200.

The plate 214 may be positioned within the midsole of the sole 200, at a height 216 above the bottom surface 208 of the sole 200 that is less than a thickness 218 of the sole 200. In other words, the plate 214 is embedded in the midsole at a mid-point along the thickness 218 of the sole 200 such that at least a portion of the thickness 218 of the midsole is positioned between the plate 214 and the ground. The height 216 of the plate 214, relative to the bottom surface 208 of the sole 200, may be selected to provide shock absorption upon landing (e.g., initial contact of the sole 200 with the ground) and allow the foot to transition into an optimum position for takeoff (e.g., when the foot leaves the ground). For example, the plate 214 may be arranged within the sole 200 directly below the wearer's foot, and closer to the ground than to the foot while maintaining sufficient thickness of the sole 200 beneath the plate 214 to preserve a structural integrity of the sole 200. In one example, a thickness of the sole 200 under the plate 214 may be at least 4 mm.

A material of the plate 214 may be any material able to provide a desired stiffness and elasticity, such as nylon, carbon fiber, etc. The plate 214 may thereby conduct a load, e.g., an applied force, along the length of the plate 214 based on a rigidity of the plate 214. For example, the material of the plate 214 may be less flexible and more resistant to bending than the material of the midsole and may be positioned to resist flexing of the sole 200 in a targeted portion of the sole 200. A profile of the plate 214 may, as one example, match the complex curve profile of the sole 200. However, in other examples, the profile of the plate 214 may differ from the profile of the sole 200.

By configuring a sole with a complex curve and a plate embedded in the sole, a wearer's foot may land on the ground and spring off of the ground at dorsiflexion and plantar flexion angles that reduce a duration of contact of the sole with the ground during a running or walking stride. For example, insufficient dorsiflexion may cause a "loose" foot effect and cause the foot to strike the ground at an angle that results in poor energy transfer. Insufficient or excessive plantar flexion may result in reduced power output through the foot during launch. By tuning the complex curve to provide target landing and exit angles, and incorporating the plate to provide a desired resistance to flexion through a central region of the sole, loss of energy is minimized and power may be transferred to the foot via posterior chain muscles of the wearer.

Furthermore, by controlling the landing and exit angles of the sole, stresses imposed on the wearer's foot may be reduced, as well as ankle plantar moments and first medial force peak. The curves of the sole profile, at a ball region and a heel region of the sole, may be varied depending on end use (e.g., walking versus running, long distance running versus sprinting, etc.) to promote smooth progression of weight transfer through the foot.

An example of curves used to generate a complex curve for a sole profile is depicted in FIG. 3. As described herein, the complex curve refers to a shape of a bottom contour of the sole from a side view perspective. As shown in FIG. 3, a footwear article 300 is illustrated with a simplified upper 302 and a sole 304 coupled to a bottom portion of the upper 302. The sole 304 includes a midsole 306, an outsole 308, and a plate 310 embedded in the midsole 306 and extending along a portion of a length 312 of the sole 304. The set of regions (e.g., the heel region 114, the central region 116, and the ball region 118) of FIGS. 1 and 2 are indicated in FIG. 3, as well as a heel end 314 and a toe end 316 of the footwear article 300. The plate 310 may be curved with a profile that matches the complex curve of the sole 304 at the heel region 114 and the ball region 118. A curvature of the plate 310 along the central region 116 may be concave and opposite of curvatures of the sole 304 at the heel region 114 and the ball region 118.

The sole 304 has the first point of contact 120 and the second point of contact 122 of FIGS. 1 and 2. The first contact point 120 corresponds to an intersection of the central region 116 with the heel region 114 and the second contact point 122 corresponds to an intersection of the central region 116 with the ball region 118. Further, each contact point may represent a point that a curve of the complex curve of the sole 304 contacts the ground. For example, at the first contact point 120, the curvature of the sole 304 along the heel region 114 may be determined based on a first curve 318 and the first contact point 120 represents a point of contact between the first curve 318 and the ground. The first curve 318 may be a constant curve following the curvature of sole 304 along the heel region. The first curve may not be a progressive curve. A progressive curve may not be described by a single radius, but instead the radius of curvature following the heel region increases or decreases moving away from central region 116. For example, the heel of article of footwear 300 may not be on a different curve than the rest of the heel portion.

The first curve 318 may have a radius that allows the first curve 318 to provide a target landing angle, such as the landing angle α of FIG. 2. In one example, the radius of the first curve 318 may be 300 mm, which may correspond to a landing angle of 17°. In some examples, the landing angle may be between 10° to 24°. In alternate examples, the landing angle may be between 10° and 30°. However, the radius may be varied depending on an intended use of the footwear article. Varying the radius of the first curve 318 may moderate a location of the first point of contact 120 along the sole 304 and alter the landing angle. For example, if the footwear article 300 is used primarily for walking, the radius of the first curve 318 may be increased and the first point of contact 120 may be shifted forward towards the toe end 316. The landing angle may decrease accordingly. If the footwear article 300 is a hybrid shoe used for both walking and running, the radius may be decreased relative to a walking shoe and the first point of contact 120 shifted the lowest point of the wearer's heel (e.g., the heel end 314). As an example, the radius of the first curve 318 may be a value in a range of 150-500 mm.

At the second point of contact 122 of the sole 304, the curvature of the sole along the ball region 118 may be determined based on a second curve 320. The second curve 320 may be a constant curve. Further, the second curve 320 may not be a progressive curve. The second point of contact 122 may represent a point of contact between the second curve 320 and the ground. The second curve 320 may have a radius that allows the second curve 320 to provide a target exit angle, such as the exit angle β of FIG. 2. A size of the target landing angle may be inversely related to a size of the target exit angle. For example, if a larger target landing angle is desired than a size of the target exit angle may be decreased or if a larger target exit angle is desired than a size of the target landing angle may be decreased. Further the size of the radius of curvature of the first curve relative to the size of the angle of curvature of the second curve may be based on the relative sizes of the target landing angle and the target exit angle.

As one example, the radius of the first curve 318 may a larger radius than the radius of the second curve 320 to provide a greater value of the exit angle relative to the landing angle. Said another way, the target landing angle may be a smaller angle than the target exit angle. For example, when the footwear article 300 is a running shoe, the exit angle may be 32°. In other examples, the exit angle may be between 27° to 37°. In further examples, the exit angle may be between 27° and 50°. The radius of the second curve 320 may be 120 mm, in one example. In other examples, the radius of the second curve 320 may be varied to adjust the landing angle, e.g., either greater or less than 32°, and the radius of the second curve 320 may be a value in a range of 80-200 mm. A ratio of the radius of the first curve 318 to the radius of the second curve 320 may be between 5:1 to 2:1. In addition, due to the greater value of the exit angle relative to the landing angle, a length of the ball region 118 may be greater length than a length of the heel region 114 of the sole 304. In an alternate embodiment the target landing angle may be larger and a target exit angle may be smaller. In such an embodiment the first curve has a smaller radius of curvature than a radius of curvature of the second curve.

Turning briefly to FIG. 6, a diagram 600 showing a range of radius of curvature of a second curve (similar to second curve 320 of FIG. 3) and corresponding toe tip points of an article of footwear. As one example a low toe tip 602 may be a first distance 604 higher than a lowest point of the sole indicated by line 606. In an exemplary embodiment first distance 604 may be 30 mm. In some examples first distance 604 may be a minimum toe tip height. In alternate examples a high toe tip 608 may be a second distance 610 from line 606. In an exemplary embodiment the second distance 610 may be 70 mm. In some examples, second distance 610 may be a maximum toe tip height.

In some examples a middle ball point 612 of the article of footwear may be a third distance 614 from the toe tip (e.g., high toe tip 608 or low toe tip 602). In some examples the third distance may be 100 mm. In an exemplary embodiment, a minimum radius of curvature may be a first toe tip curve 618 connecting a forward ball point 616 to high toe tip 608. As one example, forward ball point 616 may be a fourth distance 620 closer to the toe tip than middle ball point 612. In an exemplary embodiment fourth distance 620 is 25 mm. In such an example, first curve 618 may be a 75 mm curve. A maximum radius of curvature may be a second toe tip curve 622 connecting a rear ball point 624 to low toe tip 602. As one example, rear ball point 624 may be a fifth distance 626 further away from the toe point than middle ball point 612. For example, fifth distance 626 may be 50 mm. In such an example, a radius of second toe tip curve 622 may be 412 mm. Both first toe tip curve 618 and second toe tip curve 622 may be constant curves.

A maximum and minimum target exit angle is also shown in diagram 600. A maximum landing angle 627 may also be based on fifth distance 626 and second distance 610. As one example the maximum landing angle 627 may be 43°. A minimum exit angle 628 may be based on fifth distance 626 and first distance 604. In some examples, the minimum exit angle may be 11°. In this way, a curve such as second curve 320 of FIG. 3 and a target exit angle may be adjusted in concert. Said another way, a target exit angle may be adjusted based on a radius of curvature of the second curve 320 and the radius of curvature of the second curve 320 may be adjusted based on the target exit angle. Additionally, the radius of curvature of the second curve 320 may be in arrange between 74 mm and 412 mm.

Turning now to FIG. 7, a diagram 700 showing a range of radius of curvature of a first curve (similar to first curve 318 of FIG. 3) and corresponding heel tip points of an article of footwear. As one example, a low heel tip 702 may be a first distance 704 from a lowest point of the sole indicated by line 706. In an exemplary embodiment first distance 704 may be 10 mm. In some examples 10 mm may be a minimum heel tip point. In further examples a high heel tip point 708 may be positioned a second distance 710 above line 706. As one example, second distance 710 may be 40 mm. In some examples 40 mm may be a maximum heel tip point.

A medium heel low point 712 may be a third distance 714 from the heel tip (e.g., high heel tip 708 or low heel tip 702). As one example third distance 714 may be 60 mm. The heel low point may be shifted closer or further away from the heel tip. In one example a rear heel low point 716 may be a fourth distance 718 closer to the heel tip than medium heel low point 712. As one example, fourth distance 718 may be 10 mm. In a further example a forward heel low point 720 may be fifth distance 722 further away from the heel tip than medium heel low point 712. As one example, fifth distance 722 may be 50 mm. In some examples, a minimum radius of curvature may be shown by a first heel tip curve 724 connecting forward heel low point 720 and high heel tip point 708. As one example, a radius of first heel tip curve 724 may be 171 mm. First heel tip curve 724 may be a constant curve and may not be a progressive curve. Further, a maximum radius of curvature may be shown by a second heel tip curve 726. As one example, a radius of second curve 726 may be 556 mm. Second heel tip curve 726 may be a constant curve and may not be a progressive curve.

A maximum and minimum target landing angle is also shown in diagram 700. A maximum landing angle 727 may also be based on fourth distance 718 and second distance 710. As one example the maximum landing angle 727 may be 39°. A minimum landing angle 728 may be based on fifth distance 722 and first distance 704. As one example, the minimum landing angle 728 may be 5°. In this way a curve such first curve 318 of FIG. 3 and a target landing angle may be adjusted in concert. Said another way, a target landing angle may be adjusted based on a radius of curvature of the first curve 318 and the radius of curvature of the first curve 318 may be adjusted based on the target landing angle. Further the radius of curvature of the first curve 318 may be in a range between 171 mm and 556 mm.

FIG. 8 shows a diagram of a sole 800. Sole 800 includes a toe region as shown in diagram 600 of FIG. 6 and a heel region as shown in diagram 800. The sole may have a length 802 which includes a length of a middle portion (e.g., middle portion 116 of FIG. 1) which is between the heel region and the toe region. As shown in FIGS. 6-8. Both a toe tip curve and a heel tip curve may be constant curve defined by a single radius of curvature. In some examples a radius of curvature of the heel tip and a radius of curvature of a toe tip may be different. The heel tip curve and toe tip curve may each terminate at a toe tip and heel tip respectively. In some examples a portion of the toe or heel connecting to an upper of the article of footwear may extend past the toe tip curve or the heel tip curve. However, a substantial portion of the curvature of the toe portion and the heel portion follows the single constant curve of the toe tip curve and heel tip curve respectively.

Returning now to FIG. 3, a length 324 of the central region 116 of the sole 304, corresponding to a distance between the first point of contact 120 and the second point of contact 122, may vary depending on the radius of curvature of each of the first curve 318 and of the second curve 320. Along the central region, the complex curve of the sole 304 may extend between the first and second points of contact 120, 122 with a geometry that maintains a continuity of the complex curve and enables a smooth transition of weight through the sole 304. As described above, the central region 116 of the sole 304 may be relatively flat, as shown in FIGS. 1-3, may be curved in a concave manner, similar to the curvature of the plate 310 through the central region 116, or in a convex manner.

By configuring the plate 310 with a concave curvature (e.g., concave when looking down at plate 310 through upper 302) through the central region 116 of the sole 304, the plate 310 may resist a downward force, as indicated by arrow 322, imposed on the plate 310 as the wearer's weight is transferred from the heel region 114 to the ball region 118 through the central region 116. The force may be distributed across the length of the plate 310. For example, a greater rigidity of a material of the plate 310 relative to a material of the midsole 306 may mitigate excessive flexing of the wearer's ankle and foot and allow energy to be transmitted from the heel region 114 to the ball region 118 of the sole 304 rapidly and efficiently. A degree of concavity (through the central region 116) and a stiffness of the plate 310 may therefore be tuned to accommodate an expected amount of force applied to the sole 304 during activity. As an example, the plate 310 may be more concave through the central region 116 and/or stiffer when the footwear article 300 is a running shoe than when the footwear article 300 is a walking shoe, due to higher impact upon the foot striking the ground during running compared to walking.

Variations in a complex curve of a sole profile are shown in FIGS. 4 and 5. Turning to FIG. 4, a simplified sole 400 is depicted having a concave bottom contour 402 (e.g., concave when looking the sole 400 from the ground) through the central region 116 of the sole 400. The concave bottom contour may provide a smooth and continuous transition in the complex curve of the sole 400 from the heel region 114 to the ball region 118. In some examples, the central region 116 may not contribute to performance of the sole 400 for an activity. As such, the central region 116 may be carved out and/or shaped to provide a desired aesthetic. In another example, the central region 116 may be configured to provide a splaying suspension to the sole 400.

As shown in FIG. 5 in another example of a sole 500 with a complex curve, the central region 116 may include a convex bottom contour with a shorter relative length than the central region 116 shown in FIGS. 1-4. For example, a first curve 504 of the complex curve corresponding to the first point of contact 120 may be have a similar radius as a second curve 502 corresponding to the second point of contact 122. The central region 116 may have a curvature that matches the first curve and the second curve such that sole 500 has a profile that forms a single, smooth, continuous curve. As such, the first and second points of contact 120, 122 may not be discrete points of contact but rather edges of a region of the sole 500 that is in contact with the ground, which may provide a different aesthetic from sole configurations where the bottom contour central region 116 is carved out or concave. A proportion of the sole 304 that is in contact with the ground when the sole 304 is in a neutral position may vary depending on the geometry of the central region 116. For example, contact between the sole 304 and the ground may be greater when the central region 116 is flat or convex than when the central region 116 is concave.

In this way, a sole for a footwear article may provide efficient energy transfer through a wearer's foot and between the foot and the ground, while promoting optimal flexion of the wearer's foot and ankle. The sole may have a profile incorporating a complex curve, where the complex curve may be generated based on a first curve overlaid with a heel region of the sole and a second curve overlaid with a ball region of the sole. A central region of the sole, between the heel region and the ball region, may be configured to provide a smooth transition of weight and contact through the sole. The first and second curves may be selected to impart the sole with target landing and exit angles, which may moderate foot position as the foot strikes and pushes off the ground. The sole may further include a plate embedded within a midsole of the sole to provide a load transfer mechanism that may reduce loss of energy and may transfer loads at a desired rate through the sole, thereby reducing wearer fatigue. The complex curve of the sole and a configuration of the plate may be adjusted according to activity to optimize their effects on a wearer's performance.

The disclosure also provides support for a footwear article, comprising: a sole having a bottom profile with a complex curve, the complex curve formed of a first curve at a heel region of the sole to provide a target landing angle of the sole, and a second curve at a ball region of the sole to provide a target exit angle of the sole, wherein the first curve and the second curve are constant curves. In a first example of the system, a size of the target landing angle is inversely related to a size of the target exit angle, and wherein a size of a radius of curvature of the first curve relative to a size of a radius of curvature of the second curve is based on relative sizes of the target landing angle and target exit angle. In a second example of the system, optionally including the first example, an apex of the target landing angle is a first point of contact of the sole with a ground surface, and wherein an apex of the target exit angle is a second point of contact of the sole with the ground surface. In a third example of the system, optionally including one or both of the first and second examples, the ball region of the sole, the ball region extending between the second point of contact and a toe end of the footwear article, has a greater length than the heel region of the sole, the heel region extending between the first point of contact and a heel end of the footwear article, and wherein a length of the ball region is equal to a third of a length of a last used to form the footwear article. In a fourth example of the system, optionally including one or more or each of the first through third examples, when the footwear article is in a neutral position, the heel region and the ball region of the sole do not contact a ground surface. In a fifth example of the system, optionally including one or more or each of the first through fourth examples, a radius of curvature of the first curve is in a range between 556 mm and 170 mm, and wherein a radius of curvature of the second curve is in a range between 75 mm and 412 mm. In a sixth example of the system, optionally including one or more or each of the first through fifth examples, the target exit angle is in a range of 10° to 30° and the target landing angle is in a range of 27° to 50°, and wherein the target exit angle is decreased when the footwear article is a walking shoe and increased when the footwear article is a running shoe. In a seventh example of the system, optionally including one or more or each of the first through sixth examples, the footwear article further includes a plate embedded in the sole, the plate having an increased stiffness relative to a material of the sole and formed of one or more of nylon and carbon fiber.

The disclosure also provides support for a sole for a footwear article, comprising: an outsole configured to interface with a ground surface, a midsole coupled to an upper surface of the outsole, the midsole having a bottom contour formed of more than one curve, including a first curve and a second curve, with a transition region extending between the first curve and the second curve, wherein the first curve and the second curve are constant curves. In a first example of the system, the transition region has one of a flat bottom contour or a convex bottom contour, and the outsole is in contact with the ground surface at the transition region when the footwear article is in a neutral position. In a second example of the system, optionally including the first example, the transition region has a concave bottom contour and the outsole is not in contact with the ground surface at the transition region. In a third example of the system, optionally including one or both of the first and second examples, the outsole contacts the ground surface at an intersection of the first curve and the transition region and at an intersection of the second curve and the transition region, and wherein a ratio of a radius of curvature of the second curve to a radius of curvature of the first curve is in a range of 2:1 to 5:1. In a fourth example of the system, optionally including one or more or each of the first through third examples, the intersection of the first curve and the transition region is aligned with a lowest point of a heel of a last used to form the sole, and wherein the intersection of the first curve and the transition region is shifted forward from the lowest point of the heel of the last by up to 75 mm toward a toe end of the sole and shifted rearward from the lowest point of the heel of the last by up to 10 mm toward a heel end of the sole depending on a target landing angle of the sole. In a fifth example of the system, optionally including one or more or each of the first through fourth examples, the intersection of the second curve and the transition region is aligned with a point equal to a quarter of a length of a last used to form the sole, and wherein the intersection of the second curve and the transition region is shifted forward by up to 25 mm toward a toe end of the sole and shifted rearward by up to 75 mm toward a heel end of the sole relative to the point depending on a curvature of the second curve and a target exit angle of the sole.

The disclosure also provides support for a footwear article, comprising: a sole having an insole, a midsole, and an outsole, the sole having a bottom profile formed of at least two curves with different radii, and a plate embedded in the sole at a mid-point along a thickness of the sole, the plate formed of a less flexible material than the midsole, and wherein the plate has a profile that matches the at least two curves. In a first example of the system, the plate is concave through a central region of the sole. In a second example of the system, optionally including the first example, the profile of the plate matches the bottom profile of the sole along an entire length of the plate. In a third example of the system, optionally including one or both of the first and second examples, the plate is positioned at least 4 mm above a ground surface. In a fourth example of the system, optionally including one or more or each of the first through third examples, the plate extends along a range of 30%-80% of a length of the sole. In a fifth example of the system, optionally including one or more or each of the first through fourth examples when the footwear article is a running shoe, the plate is more stiff and more concave through a central region of the sole than when the footwear article is a walking shoe.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

FIGS. 1-7 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. FIGS. 1-5 are drawn approximately to scale, although other dimensions or relative dimensions may be used.

This written description uses examples to disclose the invention, including the best mode, and also to enable a person of ordinary skill in the relevant art to practice the invention, including making and using any articles, devices, or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A footwear article, comprising:

a sole having a bottom profile with a complex curve, the complex curve formed of a first curve at a heel region of the sole to provide a target landing angle of the sole, and a second curve at a ball region of the sole to provide a target exit angle of the sole, and a transition region extending between the first curve and the second curve, wherein the first curve and the second curve are each constant curves, and wherein a radius of the first curve is larger than a radius of the second curve.

2. The footwear article of claim 1, wherein a size of the target landing angle is inversely related to a size of the target exit angle, and wherein a size of a radius of curvature of the first curve relative to a size of a radius of curvature of the second curve is based on relative sizes of the target landing angle and target exit angle.

3. The footwear article of claim 1, wherein an apex of the target landing angle is a first point of contact of the sole with a ground surface, and wherein an apex of the target exit angle is a second point of contact of the sole with the ground surface, wherein the ball region of the sole, the ball region extending between the second point of contact and a toe end of the footwear article, has a greater length than the heel region of the sole, the heel region extending between the first point of contact and a heel end of the footwear article, and wherein a length of the ball region is equal to a third of a length of a last used to form the footwear article.

4. The footwear article of claim 1, wherein when the footwear article is in a neutral position, the heel region and the ball region of the sole do not contact a ground surface.

5. The footwear article of claim 1, wherein a radius of curvature of the first curve is in a range between 556 mm and 170 mm, and wherein a radius of curvature of the second curve is in a range between 75 mm and 412 mm.

6. The footwear article of claim 1, wherein the target landing angle is in a range of 10° to 30° and the target exit angle is in a range of 27° to 50°, and wherein the target exit angle is decreased when the footwear article is a walking shoe and increased when the footwear article is a running shoe.

7. The footwear article of claim 1, wherein the footwear article further includes a plate embedded in the sole, the plate having an increased stiffness relative to a material of the sole and formed of one or more of nylon and carbon fiber.

8. The footwear article of claim 1, wherein the heel region extends continuously from a heel end of the footwear article to a first point of contact between the sole and a ground surface and the ball region extends continuously from a toe end of the footwear article to a second point of contact between the sole and the ground surface, and wherein the transition region is between the first point of contact and the second point of contact.

9. The footwear article of claim 8, wherein a length of the transition region is longer than the heel region and longer than the ball region.

10. The footwear article of claim 8, wherein the footwear article further includes a plate embedded in the sole and the plate extends from the heel region through the transition region to the ball region, and wherein the plate extends further into the heel region than into the ball region.

11. A sole for a footwear article, comprising:

an outsole configured to interface with a ground surface;

a midsole coupled to an upper surface of the outsole, the midsole having a bottom contour formed of more than one curve, including a first curve and a second curve, with a transition region extending between the first curve and the second curve, wherein the first curve and the second curve are constant curves, and wherein the transition region is flat with a linear profile.

12. The sole of claim 11, wherein the transition region has a flat bottom contour, and the outsole is in contact with the ground surface at the transition region when the footwear article is in a neutral position.

13. The sole of claim 11, wherein the outsole contacts the ground surface at an intersection of the first curve and the transition region and at an intersection of the second curve and the transition region, and wherein a ratio of a radius of curvature of the second curve to a radius of curvature of the first curve is in a range of 2:1 to 5:1.

14. The sole of claim 13, wherein the intersection of the first curve and the transition region is aligned with a lowest point of a heel of a last used to form the sole, and wherein the intersection of the first curve and the transition region is shifted forward from the lowest point of the heel of the last by up to 75 mm toward a toe end of the sole and shifted rearward from the lowest point of the heel of the last by up to 10 mm toward a heel end of the sole depending on a target landing angle of the sole.

15. The sole of claim 13, wherein the intersection of the second curve and the transition region is aligned with a point equal to a quarter of a length of a last used to form the sole, and wherein the intersection of the second curve and the transition region is shifted forward by up to 25 mm toward a toe end of the sole and shifted rearward by up to 75 mm toward a heel end of the sole relative to the point depending on a curvature of the second curve and a target exit angle of the sole.

16. A footwear article, comprising:

a sole having an insole, a midsole, and an outsole, the sole having a bottom profile formed of at least two curves with different radii of curvature, wherein the at least two curves includes a toe tip curve and a heel tip curve, the toe tip curve having a radius of curvature in a range between 75 mm and 412 mm and the heel tip curve having a radius of curvature in a range between 171 mm and 556 mm, and wherein the bottom profile includes a flat transition region extending between the heel tip curve and the toe tip curve.

17. The footwear article of claim 16, wherein the footwear article further includes a plate embedded in the sole at a mid-point along a thickness of the sole, the plate formed of a less flexible material than the midsole, and wherein the plate has a profile that matches the at least two curves, and wherein the plate is concave through a central region of the sole.

18. The footwear article of claim 17, wherein the profile of the plate matches the bottom profile of the sole along an entire length of the plate.

19. The footwear article of claim 17, wherein the plate is positioned at least 4 mm above a ground surface.

20. The footwear article of claim 16, wherein the plate extends along a range of 30%-80% of a length of the sole, and wherein, when the footwear article is a running shoe, the plate is more stiff and more concave through a central region of the sole than when the footwear article is a walking shoe.

* * * * *